US007739819B2

(12) United States Patent
Hansen, Jr.

(10) Patent No.: US 7,739,819 B2
(45) Date of Patent: Jun. 22, 2010

(54) ADVERTISING SIGN

(75) Inventor: David J. Hansen, Jr., Geneva, IL (US)

(73) Assignee: Imageforward, Inc., Geneva, IL (US)

( * ) Notice: Subject to any disclaimer, the term of this patent is extended or adjusted under 35 U.S.C. 154(b) by 0 days.

(21) Appl. No.: 12/319,256

(22) Filed: Jan. 5, 2009

(65) Prior Publication Data

US 2009/0119960 A1 May 14, 2009

Related U.S. Application Data

(63) Continuation of application No. 10/831,278, filed on Apr. 23, 2004, now Pat. No. 7,506,465.

(51) Int. Cl.
*G09F 15/00* (2006.01)

(52) U.S. Cl. ..... 40/606.01; 40/606.18

(58) Field of Classification Search ..... 40/606.01, 40/606.18

See application file for complete search history.

(56) References Cited

U.S. PATENT DOCUMENTS 5,787,621 A * 8/1998 Leksell ..... 40/607.03

* cited by examiner

*Primary Examiner*—Cassandra Davis
(74) *Attorney, Agent, or Firm*—Law Office of John W. Harbst

(57) ABSTRACT

An advertising sign configured for use in combination with a free standing security system having first and second sides and which is adapted to be arranged in proximity to an ingress/egress opening to a store. The advertising sign has axially aligned open ends and is sized and shaped to slidably fit over a lengthwise portion of the free standing security system. The advertising sign has first and second opposed side edges along with top and bottom edges. The advertising sign further includes first and second surfaces between the edges with an advertisement disposed upon each of the first and second surfaces. After being fitted about the security system, a distance between the top and bottom edges of the advertising sign is less than a distance between the top and bottom edges of the free standing security system but with more than 60% of both sides of the free standing security system being covered by the advertising sign such that the advertisement on both sides of the advertising sign allows the security system to also serve as a point-of-purchase advertising medium viewable from either side of the free standing security system whereby guaranteeing at least two visual advertising impressions are presented by the advertising sign to every person passing the security system.

19 Claims, 3 Drawing Sheets

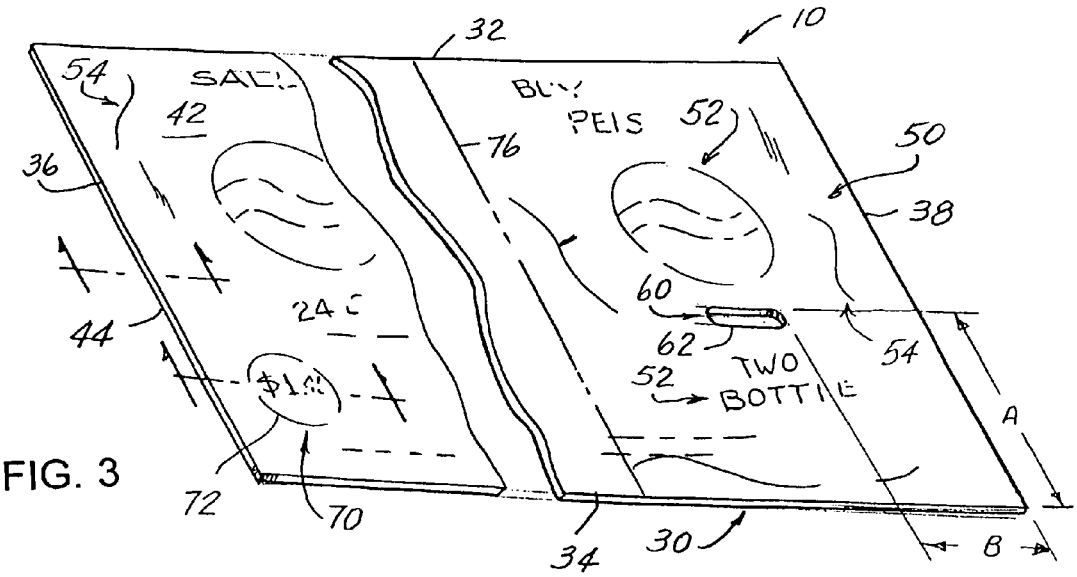
FIG. 3
FIG. 4
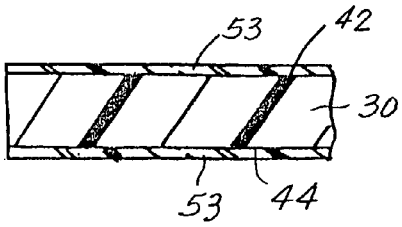
FIG. 5
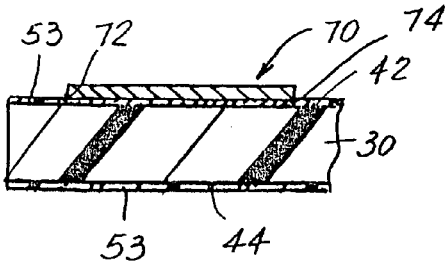
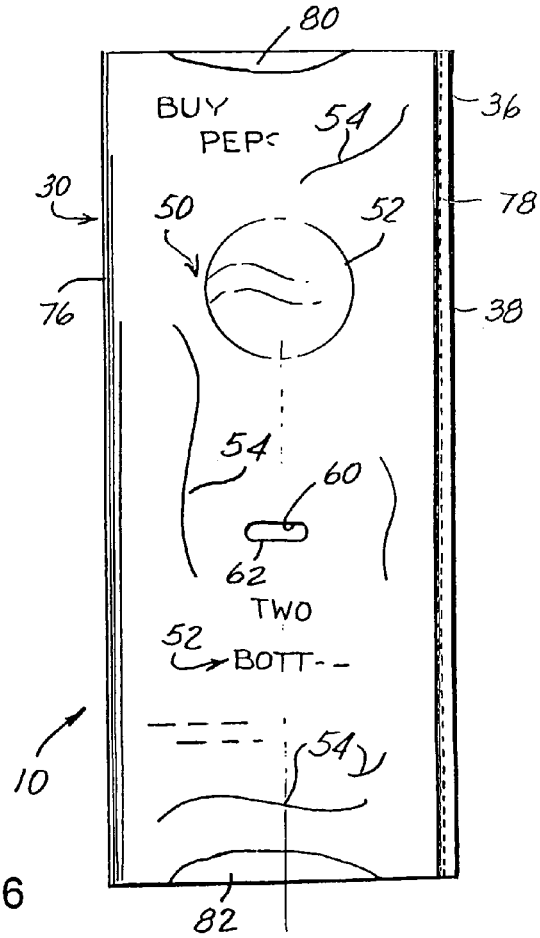
FIG. 6

ADVERTISING SIGN

RELATED APPLICATION

This application is a continuation patent application to U.S. patent application Ser. No. 10/831,278, filed Apr. 23, 2004 now U.S. Pat. No. 7,506,465.

FIELD OF THE INVENTION

The present invention disclosure generally relates to the field of display signs and, more particularly, to a display sign which converts existing space utilized by a self-supported security apparatus into a point-of-entry advertising system.

BACKGROUND OF THE INVENTION

Advertising signs are used throughout any number of various stores. Such advertising signs attract attention and inform customer's as to the availability of certain products/services in the store and, in many instances, to current sale prices for particular products/services. Signs are also used to direct customer's attention to the location of various products in the store.

The location of such in-store advertising is of paramount importance in initially grasping and attracting customer's attention to the advertised products/services offered in a particular store. Accordingly, advertisers continually strive to optimize the location of their advertising within the store. Moreover, advertisers are often prepared to spend and do, in fact, spend considerable extra money simply to improve the location of their advertising within a store. As with real estate, "location, location, location" is the number one rule in advertising. In this regard, the best possible advertising location in a store is at store level and proximate to the entry and egress location to the store. By locating an advertising sign in proximity to the entry door to the store, everyone entering and leaving the store must pass products/services being advertised.

Although having many advantages, arranging an adverting sign at store level proximate to the entry and exit door to a store is fraught with challenges and significant problems. First, arranging an advertising sign at store level and proximate to an entrance to the store naturally exposes the sign to atmospheric conditions, such as rain, snow, sleet, the damaging effects of sun exposure, and wind. As such, and when the sign extends to the floor, some signs tend to absorb and wick moisture on the floor. Such absorption and "wicking" of moisture can quickly deteriorate and, ultimately, ruin a sign. Second, arranging a sign at store level and proximate to the store entrance requires the sign to be secured in place or to have sufficient weight to prevent the sign from shifting and/or moving as a result of wind gusts blowing through the store entrance. As will be appreciated, securing the advertising sign to the floor and/or adding weight to the sign also adds to the overall costs of the sign. Of course, if the advertising signs inadvertently moves in response to wind gusts and the like blowing through the entrance, such signs can present a problem of hindering access to the store. Access to and through the entryway to a store is an especially important concern when considering handicap access to the store.

The problems associated with providing advertising in proximate relation to the store entry/exit location is exacerbated by the presence of entrance/exit security systems necessarily arranged in proximate relation to the entrance to almost every store. Given the choice between advertising and security against theft and the like, almost every store has opted for security. As is known, and albeit aesthetically unsightly, such security systems typically include a pair of five to six foot high security columns or towers arranged immediately adjacent and on opposed inner sides of a store entrance. Typically, security systems include a detection apparatus which, in one form, utilizes an infrared beam or other suitable signal, directed between and from one security tower to the other. Store owners prefer to remove the advertising from being arranged even in proximity to such security towers in view of concerns that such signs could be inadvertently moved as a result of wing gusts, inadvertent kicking or otherwise, thereby resulting in such signs blocking the signal directed between such security towers.

Thus, there is a continuing need and desire for an advertising sign which can be located adjacent to the store entrance whereby maximizing exposure of the product/services advertised while alleviating concerns over weather related deterioration, access to and through the entryway, and which serve in conjunction with existing security devices disposed proximate to the doorway.

SUMMARY OF THE INVENTION

In view of the above, and in accordance with one aspect, there is provided an advertising sign configured for use in combination with a free standing security system having first and second sides and which is adapted to be arranged in proximity to an ingress/egress opening to a store. The advertising sign has axially aligned open ends and is sized and shaped to slidably fit over a lengthwise portion of the free standing security system. The advertising sign has first and second opposed side edges along with top and bottom edges. The advertising sign further includes first and second surfaces between the edges with an advertisement being provided upon each of the first and second surfaces. After being fitted about the security system, a distance between the top and bottom edges of the advertising sign is less than a distance between the top and bottom edges of the free standing security system but with more than 60% of both sides of the free standing security system being covered by the advertising sign such that the advertisement on both sides of the advertising sign allows the security system to also serve as a point-of-purchase advertising medium viewable from either side of the free standing security system whereby guaranteeing at least two visual advertising impressions are presented by the advertising sign to every person passing the security system.

To enhance the versatility thereof, the advertising sign preferably including a sticker adhesively secured to a predetermined area on at least one of the first and second surfaces of the sign for effecting the advertising medium on the sign. Of course, and if so desired, a sticker can be adhesively secured to a predetermined area on both surfaces of the sign for effecting the advertising medium on the sign.

In one form, the advertising sign is made from vinyl. In another form, the sign is formed from a synthetic material. In still another embodiment, the advertising sign is made from plastic.

In one embodiment, the advertising sign defines an opening having a closed margin extending thereabout. The closed margin of the opening is spaced a predetermined distance from one of at least the bottom edge and the top edges of the sign such that, when the sign is fitted about and along the security system alignment is affected between the opening and a detection apparatus of the security system whereby allowing passage of a signal from the detection apparatus of the security system to pass through the sign.

According to another aspect, there is provided a replacable advertising sign arranged in combination with a free standing security system having first and second sides and which is adapted to be arranged in proximity to an ingress/egress opening to a store. The advertising sign has axially aligned open ends and is sized and shaped to slidably fit over a lengthwise portion of the free standing security system. The advertising sign has first and second opposed side edges along with top and bottom edges. The advertising sign further includes first and second surfaces between the edges with an advertisement being provided upon each of the first and second surfaces. The first and second surfaces of the sign are joined to each other along at least one of the first and second opposed sides edges. After being fitted about the security system, a distance between the top and bottom edges of the advertising sign is less than a distance between the top and bottom edges of the free standing security system but with more than 60% of both sides of the free standing security system being covered by the advertising sign such that the advertisement on both sides of the sign allows the security system to also serve as a point-of-purchase advertising medium viewable from either side of the free standing security system whereby guaranteeing at least two visual advertising impressions are presented by the advertising sign to every person passing the security system.

In a preferred form, the first and second surfaces are joined to each other along at least one of the first and second opposed sides edges by a line of stitching. Preferably, the advertising sign further includes a sticker adhesively secured to a predetermined area on at least one of the first and second surfaces of the sign for effecting changes in the advertisement provided on the sign.

In one form, the advertising sign is made from vinyl. In another form, the advertising sign formed from a synthetic material. In yet another embodiment, the advertising sign is made from plastic.

In one embodiment, the advertising sign defines an opening having a closed margin extending thereabout. The closed margin of the opening is spaced a predetermined distance from one of at least the bottom edge and the top edge of the sign such that, when the sign is fitted about and along the security system alignment is affected between the opening and a detection apparatus of the security system. As such, a signal is permitted top pass unhindered from the detection apparatus of the security system through the sign.

BRIEF DESCRIPTION OF THE DRAWINGS

FIG. 3 is a perspective view of a substrate which, in one embodiment, forms part of the present invention disclosure;

FIG. 4 is an enlarged sectional view taken along line 4-4 of FIG. 3;

FIG. 5 is an enlarged sectional view taken along line 5-5 of FIG. 3;

FIG. 6 is an elevational view of one form of an advertising sign embodying principals of the present invention disclosure.

DETAILED DESCRIPTION OF THE INVENTION

Figure 1:
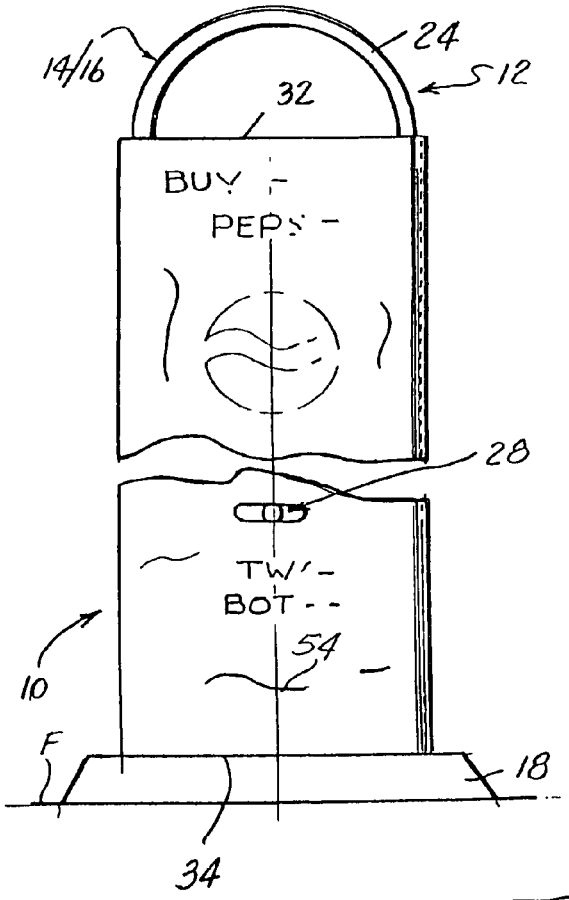
FIG. 1 is an elevational view of one form of an adverting sign, embodying principals of the present invention, shown in operable combination with one form of security system.

While the present invention is susceptible of embodiment in multiple forms, there is shown in the drawings and will hereinafter be described a preferred embodiment of the invention disclosure, with the understanding the present disclosure sets forth an exemplification which is not intended to limit the invention disclosure to the specific embodiment illustrated and described.

Figure 2:
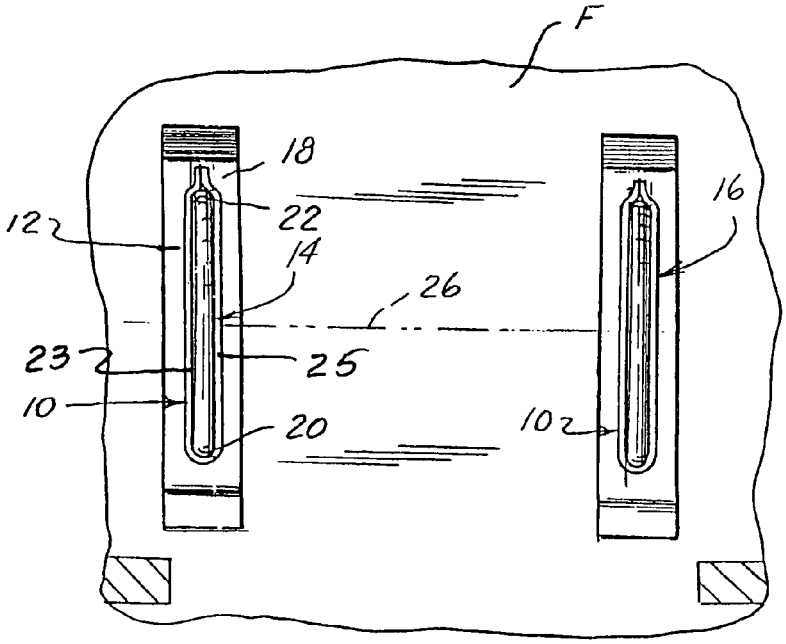
FIG. 2 is a top plan view of the advertising sign shown in FIG. 1 in operable combination with one form of security system.

Referring now to the drawings, wherein like reference numerals indicate like parts throughout the several views, FIG. 1 shows one form of an advertising sign according to the present invention disclosure generally indicated by reference numeral 10. As shown, advertising sign 10 is arranged in operable combination along and about a known security system, generally indicated by reference numeral 12. Suffice it to say, the security system 12 can be of the type manufactured by Checkpoint Systems located in Thorofare, N.J., and sold under Model Numbers QS2000 or QS 4000. As shown in FIG. 2, such a known security system 12 typically comprises two self-supporting and upstanding units 14 and 16 arranged in proximity to the entry/egress location 18, i.e. door or the like, to a store. It will be appreciated, however, the advertising sign of the present disclosure is not limited to use with any particular security unit for any particular security system. Moreover, it will be appreciated the advertising sign of the present disclosure can be used with a single self-supporting and upstanding unit of a security system without detracting or departing from the spirit and scope of the present disclosure In the illustrated embodiment, the upstanding and self-supporting units 14, 16 comprising security system 12 are substantially similar relative to each other and, thus, only unit 14 will be described in detail. As shown, each security unit 14, 16 is of a conventional self-supported or self-standing design that is configured to sit or stand on a floor F and which is designed of sufficiently dense material to provide stability to the unit 14. As illustrated by way of example in FIG. 2, unit 14 also defines a pair of opposed and generally parallel sides or faces 20 and 22 which are laterally spaced apart a predetermined distance. The parallel sides or faces 20, 22 of unit 14 extend upwardly from the floor F and are joined to each other at a top or upper end 24 (FIG. 1) of the unit 14. Moreover, and as shown by way of example in FIG. 2, unit 14 further includes spaced sides or faces 23, 25 extending upwardly from the floor F.

The units 14, 16 of the conventional security system 12 are specifically designed such that an electronic signal, i.e. an infrared light beam, schematically illustrated in FIG. 2 and identified by reference numeral 26, is directed therebetween. In the embodiment illustrated in FIG. 1, one of the units 14, 16 is designed with an apparatus 28 for delivering the electronic signal, while the other unit in the system 12 is configured and designed to receive and record such signal. It will be appreciated that the security system shown is for exemplary purposes and the advertising sign 10 of the present invention equally applies to security systems having other designs without detracting or departing for the spirit and scope of the invention.

Turning to FIG. 3, and in one embodiment, the advertising sign 10 is preferably formed from a flexible and bendable substrate 30. In a preferred embodiment, the substrate 30 is fabricated from a synthetic material selected from the class of materials including: plastic and vinyl. Preferably, substrate 30 has a thickness ranging between about 10 mils. and about 14 mils. In a most preferred form, substrate 30 has a thickness of about 12 mils.

In the embodiment shown in FIG. 3, substrate 30 has four edges including generally parallel top and bottom edges 32 and 34, respectively, and a pair of opposed and generally parallel side edges 36 and 38. In the illustrated embodiment, the edges 32, 34, 36 and 38 of the substrate 30 are preferably arranged relative to each other to provide the substrate 30 with a generally rectangularly shaped outer edge configuration. Furthermore, substrate 30 defines a first or outer major planar surface 42 on one side thereof and a second or inner major planar surface 44 on an opposite side thereof.

Advertising 50, which can include advertising indicia 52, is preferably provided on each major side or face of the sign 10. The indicia 52 printed on the sign 10 can take varied forms, i.e., words, pictures, logos and the like. In a preferred form, a predetermined pattern 54, which can include the advertising indicia 52, is provided across all or substantially the entirety of surface 42 of substrate 30. In a preferred embodiment, another predetermined pattern 54, which can include advertising indicia 52, is provided across all or substantially the entirety of surface 44 of substrate 30 whereby enhancing the versatility of the substrate 30. Preferably, the predetermined pattern 54 is printed on each planar surface of the 42, 44 of the substrate using multicolor, UV cured, solvent inks 53 (FIG. 4) thereby yielding protection to the substrate 30 against exposure to atmospheric elements, i.e. rain, sleet, snow, ice, sun and etc., so as to prolong the usefulness of the sign 10 made from the substrate 30. Alternatively, however, and without detracting or departing from the spirit and scope of this invention disclosure, the predetermined pattern 54 can be printed using any suitable type of ink commonly used for printing. Moreover, the indicia 52 and patterns 54 printed on the substrate 30 are specifically orientated and arranged to provide a desired effect when the sign 10 is arranged in combination with the security system 12.

In the form shown in FIG. 3, substrate 30 is preferably provided with a hole or aperture 60 having a closed margin 62 and which opens to both surfaces 40 and 42 of the substrate 30. Notably, the closed margin 62 of the hole or aperture 60 is spaced a predetermined distance A from the edge 34 and a predetermined distance B from the edge 38 of the imprinted substrate 30.

In the embodiment illustrated in FIGS. 3 and 5, a sticker 70 can be secured to a predetermined area 72 on either printed planar face 40, 42 of the substrate for effecting changes, i.e. price, regarding the sign 10. Such sticker 70 preferably has a self-sticking adhesive 74 (FIG. 5) on one side thereof to allow the sticker 70 to be quickly and readily replaced with a like sticker thereby changing the advertisement without having to change the entire sign 10.

With the illustrated example of the invention disclosure, and referring now to FIGS. 3 and 6, the printed substrate 30 is folded lengthwise along fold line 76 until the edges 36 and 38 are generally superimposed relative to each other. The edges 36, 38 of the substrate 30 are thereafter operably secured to each other through use of any suitable means including gluing, sonic welding, or sewing. In the most preferred form, the edges 36, 38 are operably secured together by a line of stitching 78.

Figure 7:
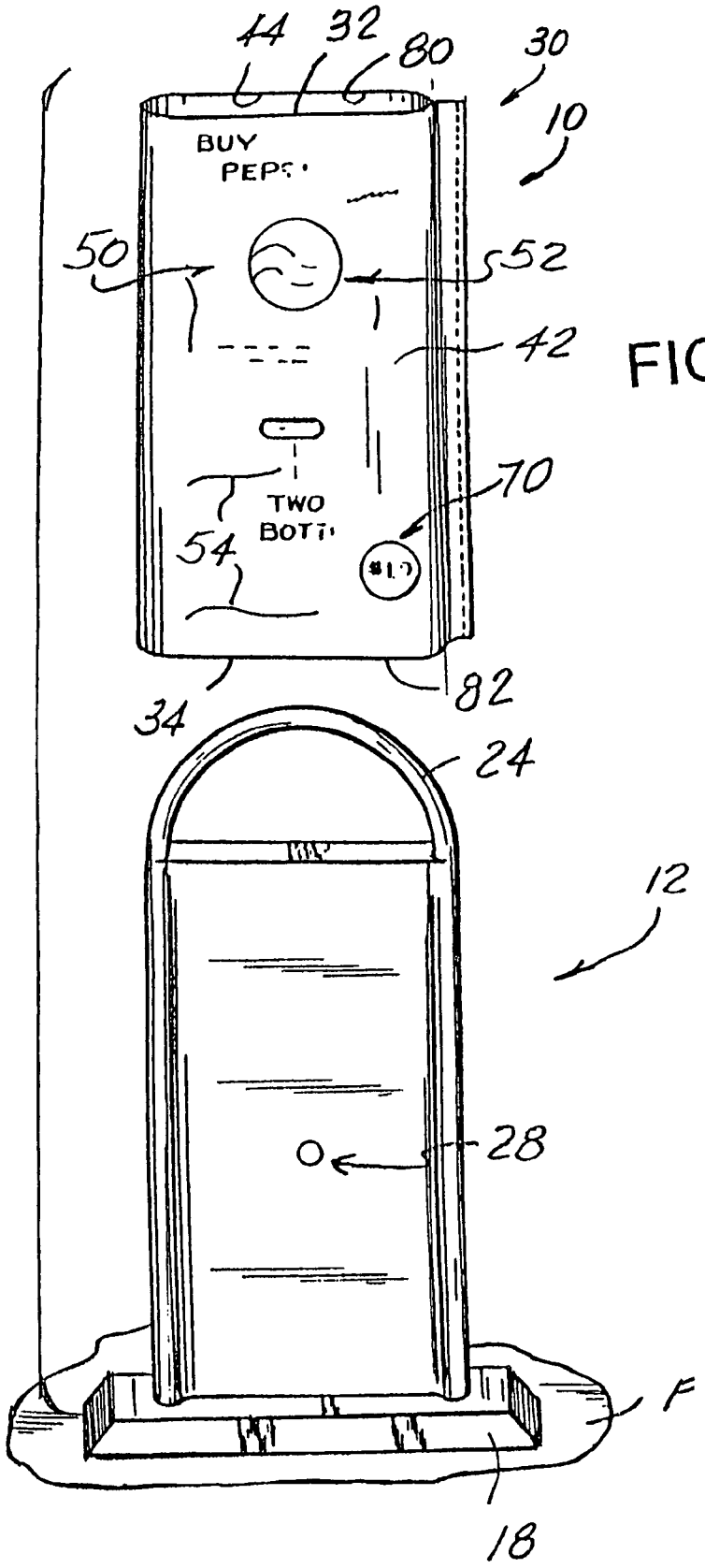
FIG. 7 is a perspective view of one form of advertising sign embodying principals of the present invention disclosure arranged separate from one form of security system.

After the edges 36, 38 are operably secured to each other, and as shown in FIG. 7, the substrate 30 is configured to form the elongated sleeve-like advertising sign 10 having a pair of axially aligned open ends 80 and 82. Notably, in the preferred embodiment, the substrate 30 is sized such that after the edges 36, 38 are operably secured to each other to form the sleeve-like advertising sign, the elongated tube-like sign 10 is configured to fit along and about a respective unit of the security system 12 (FIG. 2) with surface 42 of the sign 10 being maintained in a slightly tensioned condition, without exceeding the maximum stretch without yield of the sleeve, to enhance display of the product/services advertised on the sign 10. Moreover, the sign 10 is preferably sized such that, after being fitted along and about the respective unit of the security system 12 (FIG. 2), the distance between the top and bottom edges 32 and 34, respectively, of sign 10 is somewhat less than the distance between the bottom and top ends 18 and 24, respectively, of the security system unit about and along which the sign 10 extends. Preferably, the advertising sign 10 is sized such that, after being fitted over and along either security unit of system 12 (FIG. 2), the distance between the top and bottom edges of the sign 10 is less than the distance between the top and bottom edges of the respective unit of the free standing security system unit but with more than 60% of both sides of the free standing security system unit being covered by the advertising sign 10.

With the present invention disclosure, the existing space utilized by the aesthetically wanting security system 12 is easily and readily converted into a point-of-entry advertising system whereby optimizing exposure of the products/services displayed on sign 10 not only to select persons in the store but instead to each and every person going into and from the store. As such, not only are select persons exposed to the sign while wandering in the store but each and every person entering and leaving the store is provided with a store level reminder regarding the advertised products/services. That is, the advertising sign 10 advantageously allows each upstanding and self-supporting unit 14, 16 comprising security system 12 to serve as a point-of-purchase advertising medium viewable from either side of each unit 14, 16 whereby guaranteeing at least two visual advertising impressions are presented by the advertising sign to every person passing the security system. Moreover, and since the sign 10 adapted for use with the security system 12 is formed from a synthetic material, concerns over exposure of the sign to atmospheric elements having an adverse impact thereon are preferably eliminated. Advantageously, and after the sign 10 is arranged in operable combination with the security system 12, the weight of the security system 12 inhibits the sign 10 from moving under the influence of winds while the size and mere presence of the security system inhibits people from bumping or otherwise inadvertently moving the sign as they move through the entrance to the store.

Not only does the sign of the present invention convert existing space utilized by the security system into an aesthetically pleasing point-of-entry advertising system, the sign 10 is furthermore preferably designed as to not interfere with the on-going security measures provided by system 12. That is, the opening 60 in the sign 10 allows the security system 12 to operate in its normal mode of operation without requiring any special adjustments or modifications thereto. Moreover, aligning the opening 60 in the sign 10 with the detection apparatus 24 on the security system 12 ensures the advertising medium on sign 10 are properly orientated to provide maximum affect to the customers moving past the sign 10. Although sign 10 is preferably manufactured from a relatively inexpensive synthetic material, and is therefore expendable, the sticker 70 attachable to the sign 10 allows sign 10 to be changed to address a particular store need or desire without having to replace the entire sign 10. In either case, the sign 10 of the present invention disclosure provides an exceptionally simple and exceptionally inexpensive means of maximizing otherwise used floor space for prominently displaying certain advertised goods or services.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed:

1. In combination with a free standing security system having first and second sides and which is adapted to be arranged in proximity to an ingress/egress opening to a store, an advertising sign having axially aligned open ends and which is sized and shaped to slidably fit over a lengthwise portion of said free standing security system, said advertising sign having first and second opposed side edges along with top and bottom edges, said advertising sign further including first and second surfaces with an advertisement provided upon each of said first and second surfaces, and wherein, after being fitted about said security system, a distance between the top and bottom edges of said advertising sign is less than a distance between the top and bottom edges of said free standing security system but with more than 60% of both sides of said free standing security system being covered by said advertising sign such that the advertisement on both sides of said advertising sign allows said security system to also serve as a point-of-purchase advertising medium viewable from either side of said free standing security system whereby guaranteeing at least two visual advertising impressions are presented by said advertising sign to every person passing the security system.

2. The advertising sign according to claim 1, further including a sticker adhesively secured to a predetermined area on at least one of said first and second surfaces of said sign for effecting changes in the advertisement provided on said sign.

3. The advertising sign according to claim 1, wherein said sign is made from vinyl.

4. The advertising sign according to claim 1, wherein said sign is formed from a synthetic material.

5. The advertising sign according to claim 1, wherein said sign is made from plastic.

6. The advertising sign according to claim 1, wherein said sign defines an opening having a closed margin extending thereabout, with the closed margin of said opening defined by said sign being spaced a predetermined distance from one of at least said bottom edge and said top edges such that, when said sign is fitted about and along said security system alignment is affected between said opening and a detection apparatus of said security system whereby allowing passage of a signal from said detection apparatus of said security system to pass through said sign.

7. The advertising sign according to claim 1, wherein the top end of said sign is open.

8. In combination with a free standing security system having first and second sides and which is adapted to be arranged in proximity to an ingress/egress opening to a store, a replaceable advertising sign having axially aligned open ends and which is sized and shaped to slidably fit over a lengthwise portion of said free standing security system, said advertising sign having first and second opposed side edges along with top and bottom edges, with said advertising sign further including first and second surfaces with an advertisement provided upon each of said first and second surfaces, and with said first and second surfaces being joined to each other along at least one of said first and second opposed sides edges, and wherein, after being fitted about said security system, a distance between the top and bottom edges of said advertising sign is less than a distance between the top and bottom edges of said free standing security system but with more than 60% of both sides of said free standing security system being covered by said advertising sign such that the advertisement on both sides of said advertising sign allows said security system to also serve as a point-of-purchase advertising medium viewable from either side of said free standing security system whereby guaranteeing at least two visual advertising impressions are presented by said advertising sign to every person passing the security system.

9. The advertising sign according to claim 8, wherein said first and second surfaces are joined to each other along at least one of said first and second opposed sides edges by a line of stitching.

10. The advertising sign according to claim 8, further including a sticker adhesively secured to a predetermined area on at least one of said first and second surfaces of said sign for effecting changes in the advertisement provided on said sign.

11. The advertising sign according to claim 8, wherein said sign is made from vinyl.

12. The advertising sign according to claim 8, wherein said sign is formed from a synthetic material.

13. The advertising sign according to claim 8, wherein said sign is made from plastic.

14. The advertising sign according to claim 8, wherein said sign defines an opening having a closed margin extending thereabout, with the closed margin of said opening defined by said sign being spaced a predetermined distance from one of at least said bottom edge and said top edges such that, when said sign is fitted about and along said security system alignment is affected between said opening and a detection apparatus of said security system whereby allowing passage of a signal from said detection apparatus of said security system to pass through said sign.

15. In combination with a free standing security system having first and second sides and which is adapted to be arranged in proximity to an ingress/egress opening to a store, an advertising sign having an open bottom end and a top end which axially aligns with said bottom end, with said sign being sized to slidably fit over a lengthwise portion of said free standing security system, said advertising sign having first and second opposed side edges along with top and bottom edges, said advertising sign further including first and second surfaces with an advertisement provided upon each of said first and second surfaces, and wherein, after being fitted about said security system, a distance between the top and bottom edges of said advertising sign covers more than 60% of either side of said free standing security system such that the advertisement on both sides of said advertising sign allows said security system to also serve as a point-of-purchase advertising medium viewable from either side of said free standing security system whereby guaranteeing at least two visual advertising impressions are presented by said advertising sign to every person passing the security system.

16. The advertising sign according to claim 15, further including a sticker adhesively secured to a predetermined area on at least one of said first and second surfaces of said sign for effecting changes in the advertisement provided on said sign.

17. In combination with a free standing security system having first and second sides and which is adapted to be arranged in proximity to an ingress/egress opening to a store, a replaceable advertising sign having an open bottom end and an axially aligned top end, with said sign being sized to slidably fit over a lengthwise portion of said free standing security system, said advertising sign having first and second opposed side edges along with top and bottom edges, with said advertising sign further including first and second surfaces with an advertisement provided upon each of said first and second surfaces, and with said first and second surfaces being joined to each other along at least one of said first and second opposed sides edges, and wherein, after being fitted about said security system, a distance between the top and bottom edges of said advertising sign covers more than 60% of either side of said free standing security system and such that the advertisement on both sides of said advertising sign allows said security system to also serve as a point-of-purchase advertising medium viewable from either side of said free standing security system whereby guaranteeing at least two visual advertising impressions are presented by said advertising sign to every person passing the security system.

18. The advertising sign according to claim 17, wherein said first and second surfaces are joined to each other along at least one of said first and second opposed sides edges by a line of stitching.

19. The advertising sign according to claim 17, further including a sticker adhesively secured to a predetermined area on at least one of said first and second surfaces of said sign for effecting changes in the advertisement provided on said sign.

* * * * *